US009861133B2

(12) United States Patent
Li et al.

(10) Patent No.: US 9,861,133 B2
(45) Date of Patent: Jan. 9, 2018

(54) ELECTRONIC CIGARETTE

(71) Applicant: SHENZHEN FIRST UNION TECHNOLOGY CO., LTD., Shenzhen, Guangdong Province (CN)

(72) Inventors: Yonghai Li, Shenzhen (CN); Zhongli Xu, Shenzhen (CN); Yonglu Guo, Shenzhen (CN); Jianhua Weng, Shenzhen (CN); Yansheng Zhang, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 351 days.

(21) Appl. No.: 14/583,684

(22) Filed: Dec. 27, 2014

(65) Prior Publication Data

US 2015/0181944 A1 Jul. 2, 2015

(30) Foreign Application Priority Data

| | | |
|---|---|---|
| Dec. 31, 2013 | (CN) | 2013 2 0882094 U |
| Jan. 23, 2014 | (CN) | 2014 2 0042552 U |
| Jan. 23, 2014 | (CN) | 2014 2 0042876 U |
| Jan. 25, 2014 | (CN) | 2014 2 0046311 U |

(51) Int. Cl.

| | |
|---|---|
| ***A24F 47/00*** | (2006.01) |
| ***H05B 3/06*** | (2006.01) |
| ***H01R 13/24*** | (2006.01) |

(52) U.S. Cl.
CPC ..... *A24F 47/008* (2013.01); *H01R 13/2407* (2013.01); *H05B 3/06* (2013.01)

(58) Field of Classification Search
CPC ..... A24F 47/008
See application file for complete search history.

(56) References Cited

U.S. PATENT DOCUMENTS

| | | | | |
|---|---|---|---|---|
| 2014/0196734 | A1* | 7/2014 | Liu | A24F 47/008 131/329 |
| 2014/0261493 | A1* | 9/2014 | Smith | A24F 47/008 131/328 |
| 2015/0020828 | A1* | 1/2015 | Liu | A24F 47/008 131/329 |
| 2015/0027460 | A1* | 1/2015 | Liu | A24F 47/008 131/329 |
| 2015/0059783 | A1* | 3/2015 | Liu | A24F 47/008 131/329 |

* cited by examiner

*Primary Examiner* — Eric Yaary
(74) *Attorney, Agent, or Firm* — Cheng-Ju Chiang

(57) ABSTRACT

An electronic cigarette includes an atomizer and a battery pack. A pluggable connecting means is provided between the atomizer and the battery pack. The pluggable connecting means is designed as an elastic snap connection or a detachable clip means so that the atomizer and the battery pack can be connected together pluggably to prevent the threaded connection.

5 Claims, 26 Drawing Sheets

ELECTRONIC CIGARETTE

FIELD

The present disclosure relates to electronic cigarettes, and particularly to a pluggable electronic cigarette.

BACKGROUND

The existing electronic cigarette usually comprises two main components, i.e., an atomizer and a battery rod, as well as a nozzle disposed at an end of the atomizer, and an indicator light and a controlling module disposed at an end of the battery rod. The connection between the atomizer and the battery rod concerns structural connection and circuit connection simultaneously. Currently, the atomizer is usually connected to the battery rod through threads, but the atomizer needs to be inserted into the battery rod and rotated for several turns in order to be effectively connected to the battery rod during the usage of the electronic cigarette, and this makes the operation inconvenient and troublesome; mechanical processed hardware parts are utilized for the threaded connection, so the cost is relatively high; and when the connection part is rotated during the usage, the friction between metals will generate metal scraps, and this shortens the service life. According to the above description, the threaded connection has the following drawbacks that the operation is inconvenient, the cost is relatively high, and the service lift is short, and so on.

BRIEF DESCRIPTION OF THE DRAWINGS

Implementations of the present technology will now be described, by way of example only, with reference to the attached figures, wherein.

DETAILED DESCRIPTION

Figure 1:
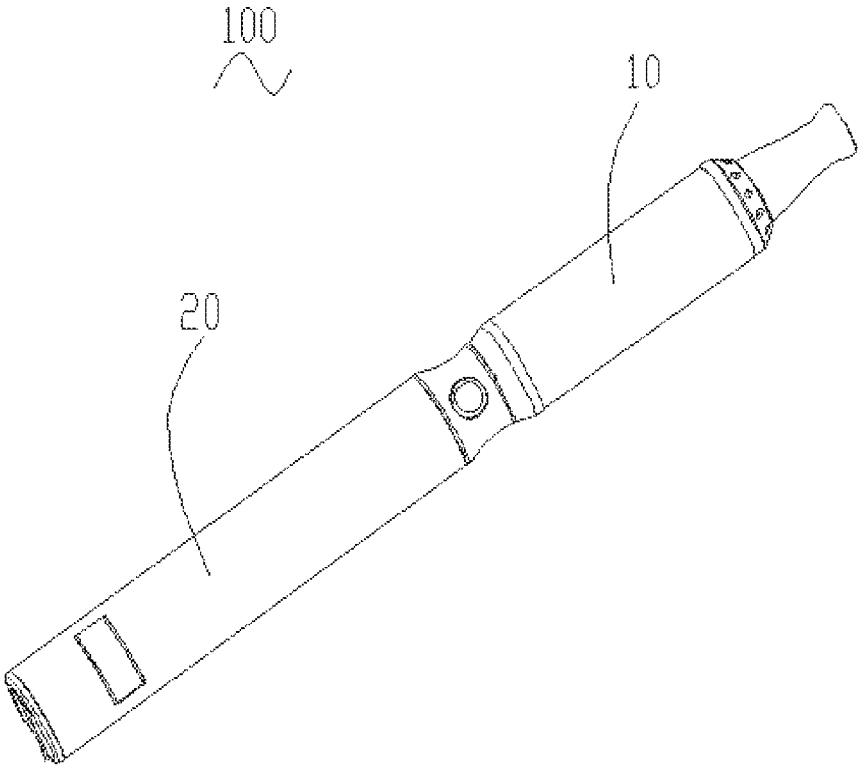
FIG. 1 is a schematic perspective view of an electronic cigarette according to one embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "outside" refers to a region that is beyond the outermost confines of a physical object. The term "inside"

indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure relates to an electronic cigarette comprising an atomizer and a battery pack which can be called power supplying component. A pluggable connecting means is provided between the atomizer and the battery pack. The pluggable connecting means is designed as an elastic snap connection or a detachable clip means so that the atomizer and the battery pack can be connected together pluggably to prevent the threaded connection. A pluggable connection in the present disclosure means that the atomizer and the battery pack are connected by inserting and pulling manner via snap or clip but not by threaded manner. The pluggable connecting means does not include the threaded connection in the present disclosure. In one embodiment which is shown as FIGS. 1-7, the connecting means comprises a first accommodating portion 13, a first inserting portion 23 and a first elastic engaging member 16, the first inserting portion 23 and the first elastic engaging member 16 are received in the first accommodating portion 13. In one embodiment which is shown as FIGS. 8-15, the pluggable connecting means comprises a first connecting end 100*a* having a non-rotational joint 101, and a second connecting end 200*a* having a joint cavity 201 adapted to match with the non-rotational joint 101 and restricts the rotation of the atomizer with respect to the power supplying component. In one embodiment which is shown as FIGS. 16-21, the connecting means comprises a first connecting end 100*b* and a second connecting end 200*b*, the first connecting end 100*b* comprises an internal electrode ring 110*b*, an insulated ring 120*b* and an elastic connecting member 130*b* nested together sequentially from inside to outside, the second connecting end 200*b* comprises an elastic electrode ring 210*b*, an insulated fixed base 220*b* and an external connecting member 230*b* nested together sequentially from inside to outside. The internal electrode ring 110*b* and the elastic electrode ring 210*b* are in contact with each other to conduct electricity, and the elastic connecting member 130*b* and the external connecting member 230*b* are in contact with each other to conduct electricity. In one embodiment which is shown as FIGS. 22-26, the connecting means comprises a first connecting portion 110*c* and a second connecting portion 210*c*, the first connecting portion 110*c* comprises a first electrode 111*c* and a second electrode 113*c*, the first electrode 111*c* and the second electrode 113*c* are distributed axially with respect to the first connecting portion 110*c*, the second connecting portion 210*c* comprises a sleeve 211*c*, an insulated base 212*c* disposed inside the sleeve 211*c*, and a first elastic sheet 213*c* and a second elastic sheet 214*c* fixed between the insulated base 212*c* and the sleeve 211*c*, a plugging cavity 2120*c* is defined within the insulated base 212*c*; and when the first connecting portion 110*c* is inserted into the plugging cavity 2120*c*, the first elastic sheet 213*c* and the second elastic sheet 214*c* abut against the second electrode 113*c* and the first electrode 111*c* respectively so that axial locking and electrical connection between the first connecting portion 110*c* and the second connecting portion 210*c* are achieved.

Figure 2:
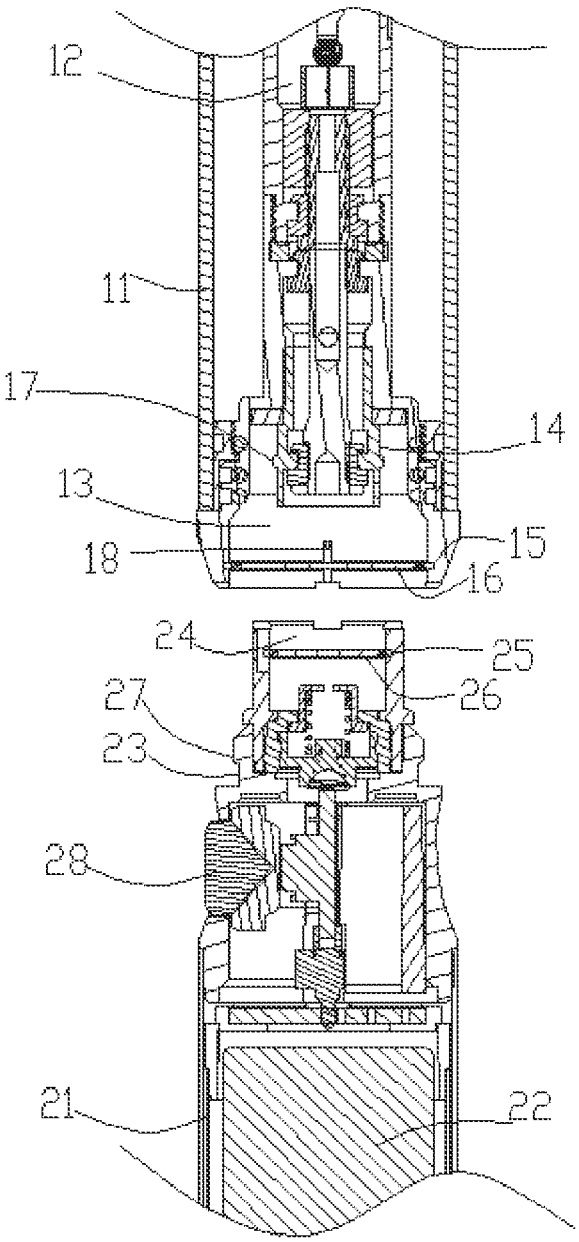
FIG. 2 is a cross-sectional view of a connection part between an atomizer and a battery pack of the electronic cigarette of FIG. 1 in a separated state.
Figure 3:
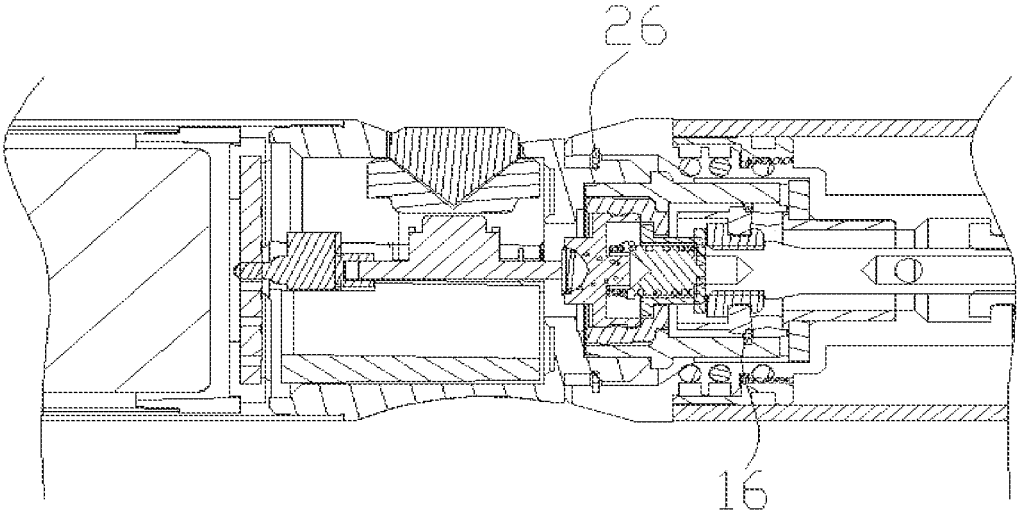
FIG. 3 is a schematic view of the connection part between the atomizer and the battery pack of the electronic cigarette of FIG. 2 in a connected state.

Referring to FIG. 1 to FIG. 3 together, an electronic cigarette 100 provided by one embodiment of the present disclosure comprises an atomizer 10 and a battery pack 20. The atomizer 10 comprises an atomizing sleeve 11, an atomizing component 12 disposed within the atomizing sleeve 11, and a connecting member disposed at an end of the atomizing sleeve 11. The battery pack 20 comprises a battery sleeve 21, a battery 22 accommodated within the battery sleeve 21, a switch button 28, and a connecting member disposed at an end of the battery sleeve 21.

In this embodiment, the connecting member at the end of the atomizer 10 forms a first accommodating portion 13, the connecting member at the end of the battery pack 20 forms a first inserting portion 23, and a second inserting portion 14 is disposed within the first accommodating portion 13. The first inserting portion 23 or the second inserting portion 14 may have electrodes built therein or may serve as electrodes themselves.

The internal wall of the first accommodating portion 13 is provided with a step 15, and an elastic engaging member 16 is inserted into the step 15. The front end of the external wall of the second inserting portion 14 is provided with a shaft shoulder 17, and the shaft shoulder 17 is a chamfering or a rounding.

The first inserting portion 23 has a hollow internal cavity, the internal cavity forms a second accommodating portion 24 of which the internal wall is provided with a step 25, and an elastic engaging member 26 is disposed on the step 25. The front end of the external wall of the first inserting portion 23 is provided with a shaft shoulder 27, and the shaft shoulder 27 is a chamfering or a rounding.

Figure 4:
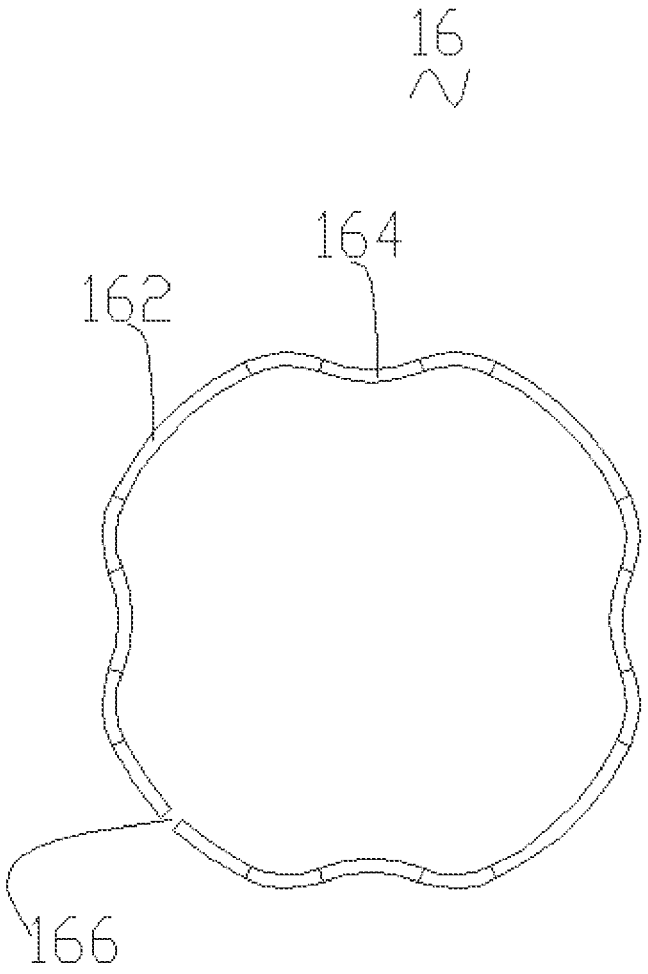
FIG. 4 is a schematic view of an elastic engaging member of FIG. 3.

In this embodiment, both the elastic engaging members 16 and 26 are clamp springs and ring-shaped with an opening 166, i.e., unclosed rings, so that the elastic engaging members can be mounted conveniently and flexible spaces can be provided during the deformation of the elastic engaging members. In this embodiment, the elastic engaging members 16 and 26 are of a same shape. Referring to FIG. 4 together, taking the elastic engaging member 16 as an example, the elastic engaging member 16 comprises supporting portions 162 adapted to be fixed on the step 15, and elastic portions 164 connected to and protruding from the supporting portions 162. The elastic portions 164 and the supporting portions 162 are spaced apart.

The elastic engaging members 16 and 26 may be made of electrically conductive metals depending on practical needs so as to provide better electrical connection between connecting members and better mechanical performance.

When the first inserting portion 23 is inserted into the first accommodating portion 13, the elastic engaging member 16 is compressed and engaged with the external wall of the first inserting portion 23 and is next to the shaft shoulder 17. Meanwhile, the second accommodating portion 24 accommodates the second inserting portion 14, and the elastic engaging member 26 is compressed and engaged with the external wall of the second inserting portion 14 and is next to the shaft shoulder 27. The shaft shoulders 17 and 27 help to stop the elastic engaging members 16 and 26, and the elastic engaging members 16 and 26 can escape from the shaft shoulders 17 and 27 when the atomizer 10 is separated from the battery pack 20.

In one embodiment, a pin 18 protruding from the internal wall of the first accommodating portion 13 is disposed on the internal wall of the first accommodating portion 13 in a direction substantially perpendicular to the circumferential direction of the elastic engaging member 16, and the pin 18 helps to prevent the elastic engaging member 16 of a relatively large size from loosing and rotating.

Figure 5:
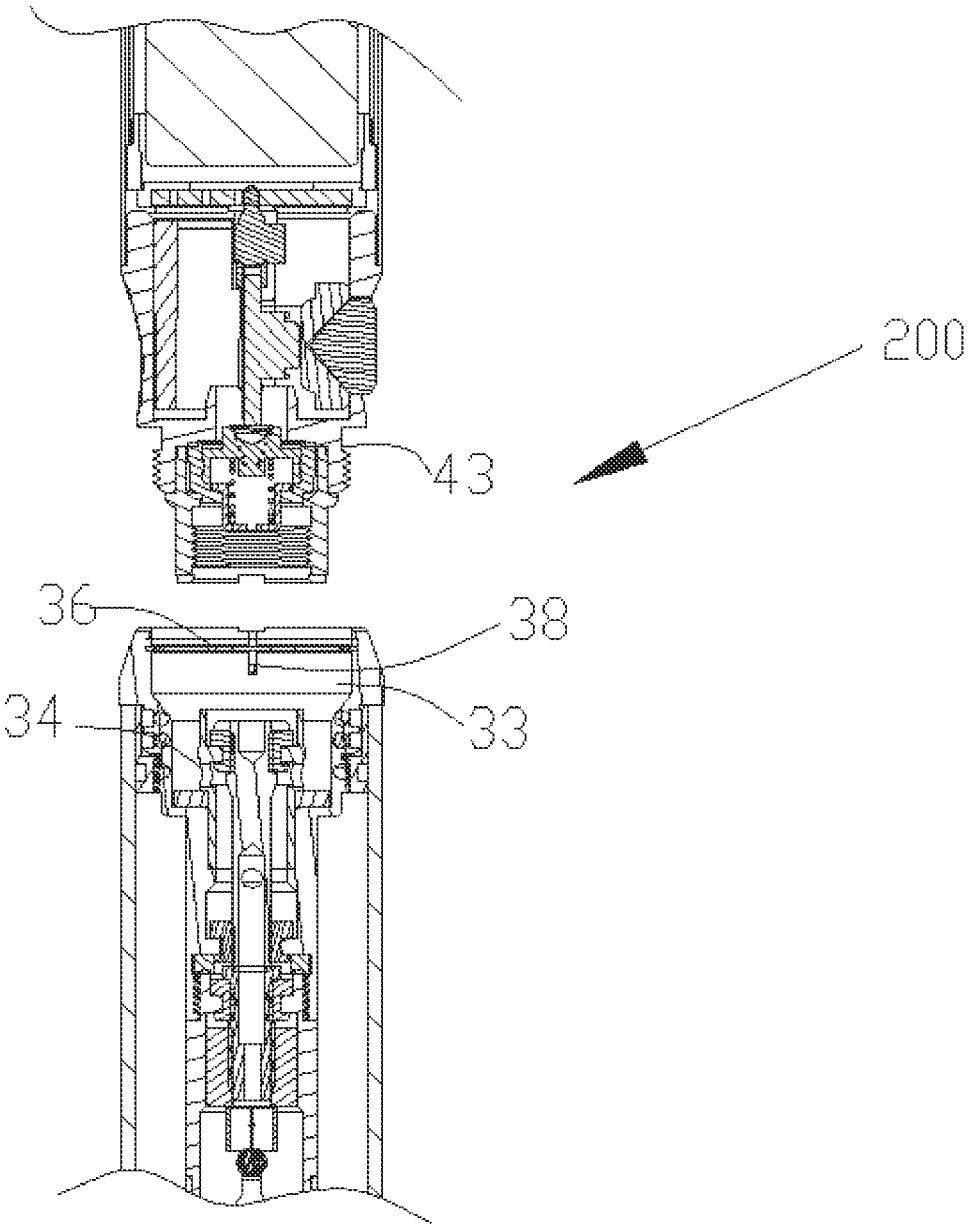
FIG. 5 is a cross-sectional view of a connection part between an atomizer and a battery pack of an electronic cigarette in a separated state according to one embodiment of the present disclosure.
Figure 6:
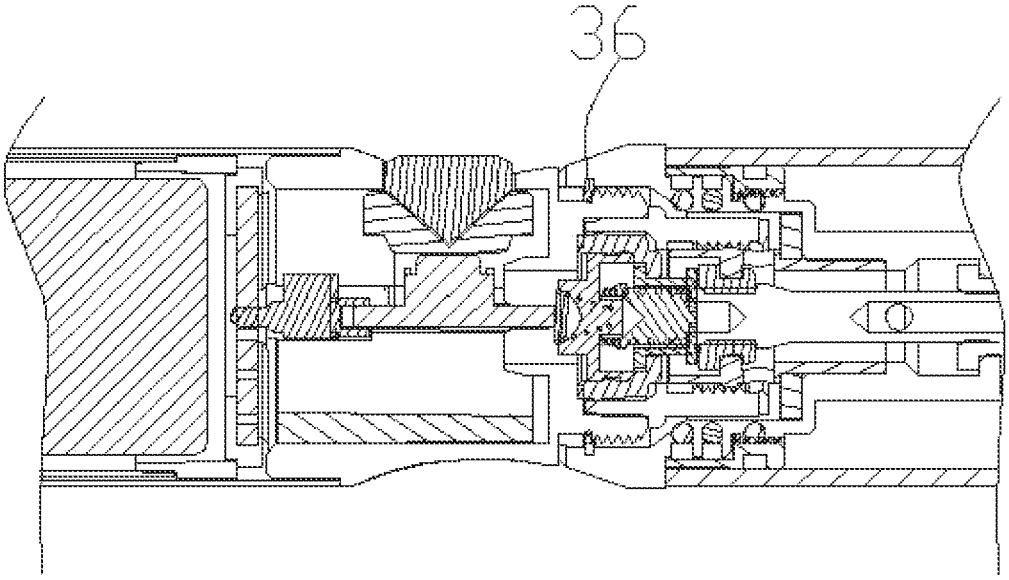
FIG. 6 is a cross-sectional view of the connection part between the atomizer and the battery pack of the electronic cigarette of FIG. 5 in a connected state.

Referring to FIG. 5 and FIG. 6 together, an electronic cigarette 200 provided by one embodiment of the present disclosure only comprises an elastic engaging member 36 and a pin 38 for preventing rotation at an end of an atomizer. Both an accommodating portion 33 and a second inserting portion 34 of the atomizer are not provided with threads. A first inserting portion 43 at an end of a battery pack is provided with threads, i.e., the battery pack may be a threaded battery pack available on the market and is just not for threaded connection.

During the connecting process, as shown in FIG. 6, the elastic engaging member 36 is compressed and engaged with the external wall of the first inserting portion 43 and is next to the threads, the threads help to stop the elastic engaging member 36, and the elastic engaging member 36 can escape from the threads when the atomizer is pulled by an external force to be separated from the battery pack.

Figure 7:
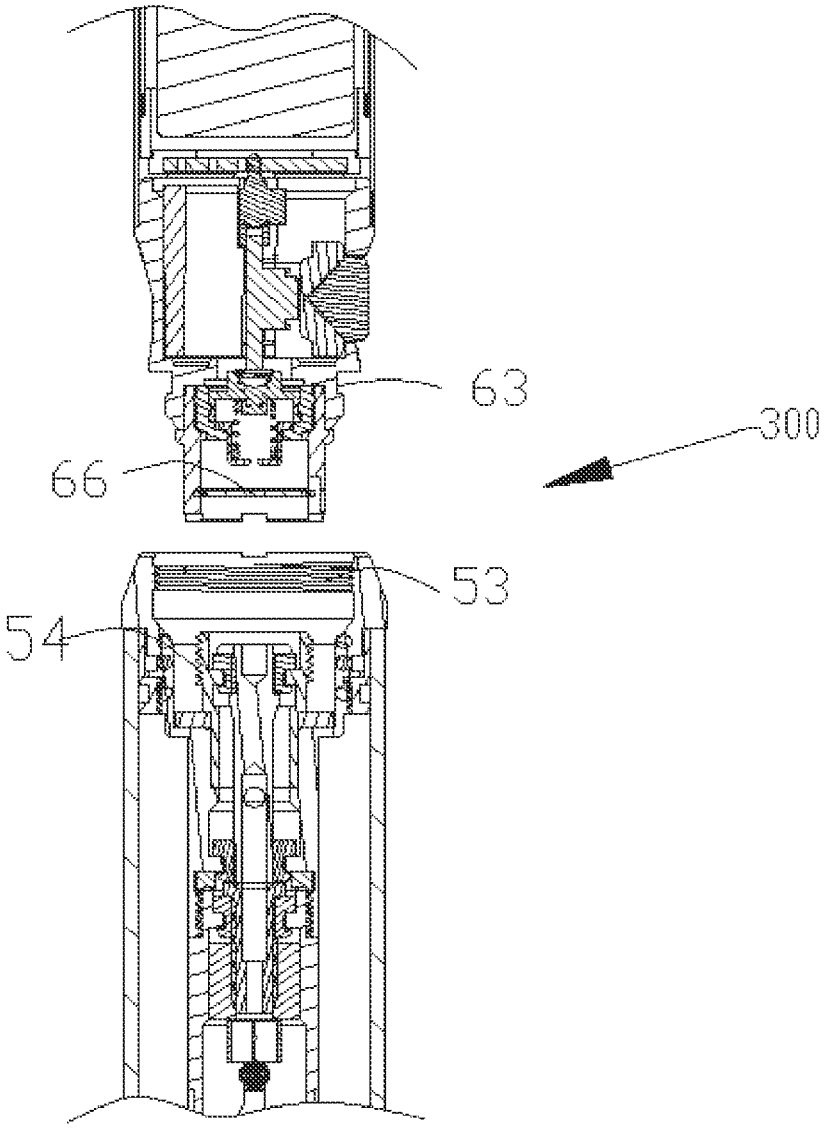
FIG. 7 is a cross-sectional view of a connection part between an atomizer and a battery pack of an electronic cigarette in a separated state according to one embodiment of the present disclosure.

Referring to FIG. 7, an electronic cigarette 300 provided by one embodiment of the present disclosure only comprises an elastic engaging member 66 at an end of a battery pack. A first inserting portion 63 of the battery pack is not provided with threads. Both an accommodating portion 53 and a second inserting portion 54 at an end of an atomizer are provided with threads, i.e., the atomizer may be a threaded atomizer available on the market and is just not for threaded connection. During the connecting process, the elastic engaging member 66 is compressed and engaged with the external wall of the second inserting portion 54 and is next to the threads, the threads of the second inserting portion 54 help to stop the elastic engaging member 66, and the elastic engaging member 66 can escape from the threads when the atomizer is pulled by an external force to be separated from the battery pack.

In the aforesaid embodiments, the naming of the first inserting portion and the second inserting portion do not indicate the order of the two portions, so the names of the two portions can exchange; and likewise, the naming of the first accommodating portion and the second accommodating portion do not indicate the order of the two portions, so the names of the two portions can also exchange. The elastic engaging member is not limited to a clamp spring, but can be any other similar member that is elastic and can be used for engagement.

According to the above descriptions, the elastic engaging member can provide elasticity for the connection between the atomizer and the battery pack so that the atomizer and the battery pack can be connected together pluggably without using threads. Moreover, even if one of the atomizer and the battery pack is a threaded atomizer or battery pack currently available on the market, the atomizer and the battery pack can still be connected together pluggably through an elastic engaging member without using threads as long as the other has the elastic engaging member.

Figure 8:
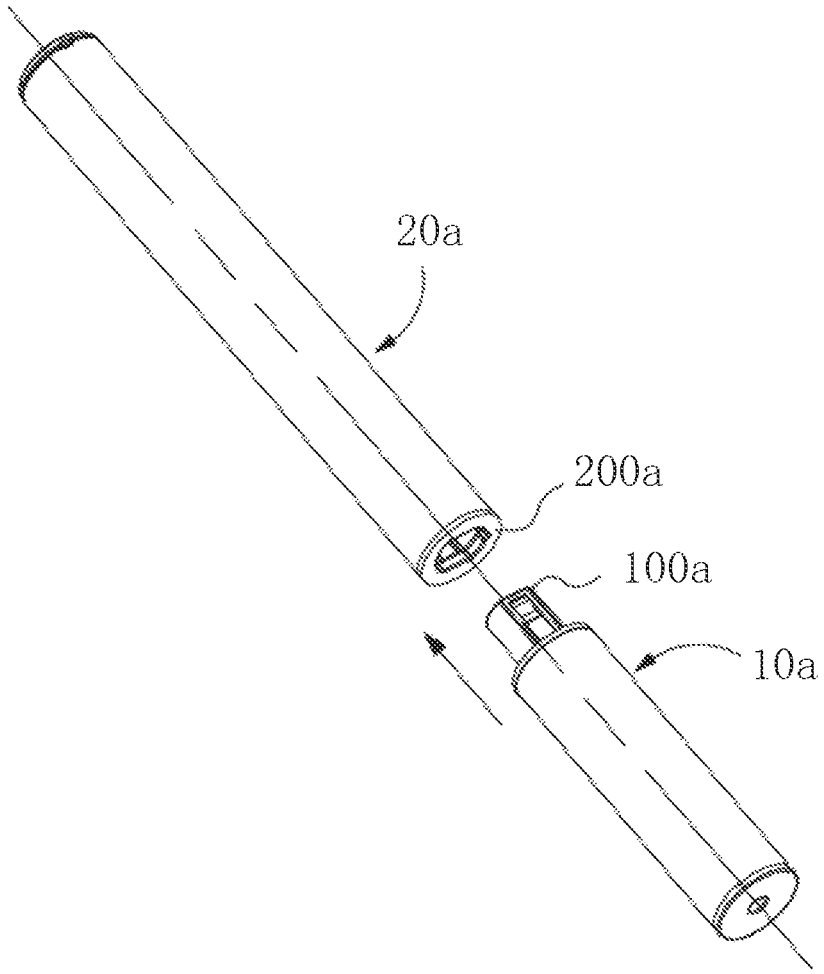
FIG. 8 is an overall schematic structural view of an electronic cigarette according to one embodiment of the present disclosure.
Figure 9:
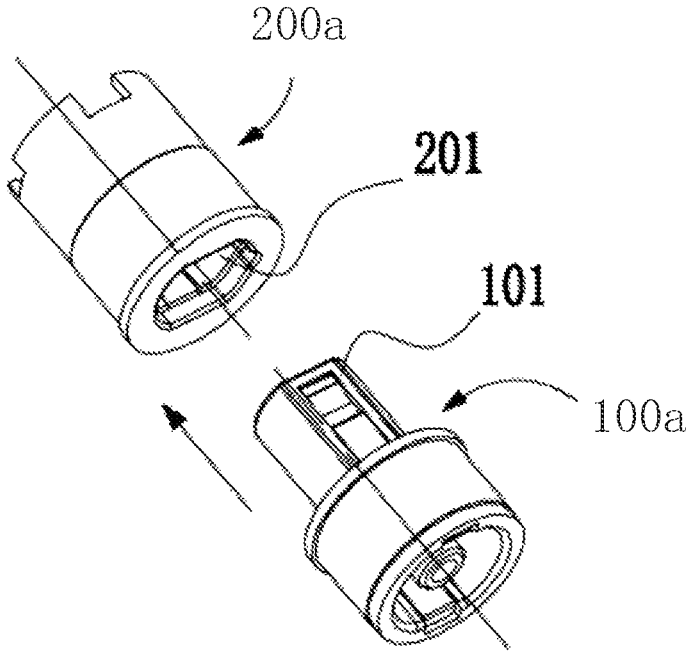
FIG. 9 is a schematic structural view of a first connecting end and a second connecting end of the electronic cigarette of FIG. 8.

Referring to FIG. 8 and FIG. 9 together, an electronic cigarette of one embodiment comprises an atomizer 10*a* and a power supplying component 20*a*, a heating element is disposed within the atomizer 10*a*, the power supplying component 20*a* comprises a power supplying element (not shown), and the power supplying element may be a dry battery, a storage battery, a micro battery or a super capacitor. The atomizer 10*a* and the power supplying component 20*a* are provided with a first connecting end 100*a* and a second connecting end 200*a* respectively, the first connecting end 100*a* has a non-rotational joint 101, and the second connecting end 200*a* has a joint cavity 201 adapted to match with the non-rotational joint 101 and restricts the rotation of the atomizer 10*a* with respect to the power supplying component 20*a*. In this embodiment, the first connecting end 100*a* is disposed at an end of the atomizer 10*a*, and the second connecting end 200*a* is disposed at an end of the power supplying component 20*a*. In other embodiments, it may also be that the first connecting end 100*a* is disposed at an end of the power supplying component 20*a*, and the second connecting end 200*a* is disposed at an end of the atomizer 10*a*.

Referring to FIG. 10 to FIG. 13, the first connecting end 100*a* comprises two first electrically conductive elastic sheets 110, a connector 120 and a fixed base 130. The two first electrically conductive elastic sheets 110 are made of copper or other electrically conductive materials, and the connector 120 and the fixed base 130 are made of insulating materials. Two limiting grooves 131 are defined axially in the fixed base 130, two locating grooves 121 are defined in the connector 120 correspondingly, and the limiting grooves 131 and the locating grooves 121 are arranged opposite to each other to define a limiting space 102 so as to restrict the axial movement of the two first electrically conductive elastic sheets 110 interposed between the connector 120 and the fixed base 130. In one embodiment, the two limiting grooves 131 are disposed symmetrically with respect to a central axis, and the section widths of the limiting grooves 131 are the same as the width of each of the first electrically conductive sheets 110 so as to fix the first electrically conductive sheets 110. The non-rotational joint 101 comprises two locating surfaces 122 disposed axially and symmetrically on the connector 120 and an arc surface 123 connecting the two locating surfaces 122, the two locating surfaces 122 are two parallel surfaces, and the first connecting end 100*a* can only be inserted into the second connecting end 200*a* along a single direction and cannot rotate with respect to the second connecting end 200*a* due to the existence of the non-rotational joint 101. The two locating surfaces 122 are parallel to the bottom surfaces of the two locating grooves 121, the two locating surfaces 122 are provided with openings 124, and part of the first electrically conductive elastic sheet 110 passes through the opening 124 to be clamped to the second electrically conductive elastic sheet 210 so as to prevent the second connecting end 200*a* from moving axially with respect to the first connecting end 100*a*.

Figure 10:
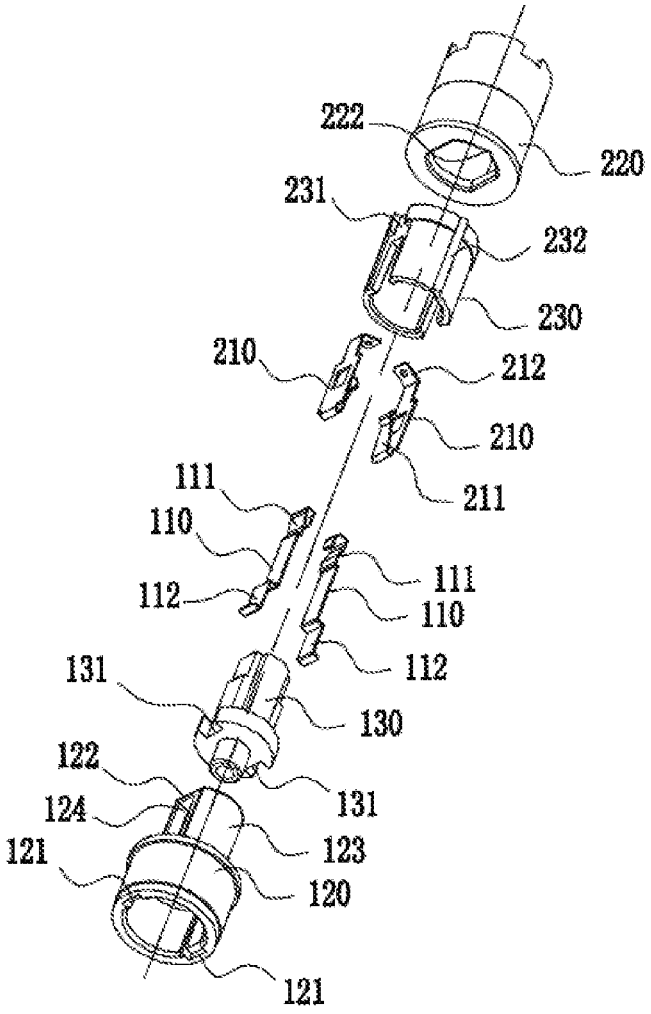
FIG. 10 is an exploded view of the first connecting end and the second connecting end of the electronic cigarette of FIG. 8.
Figure 11:
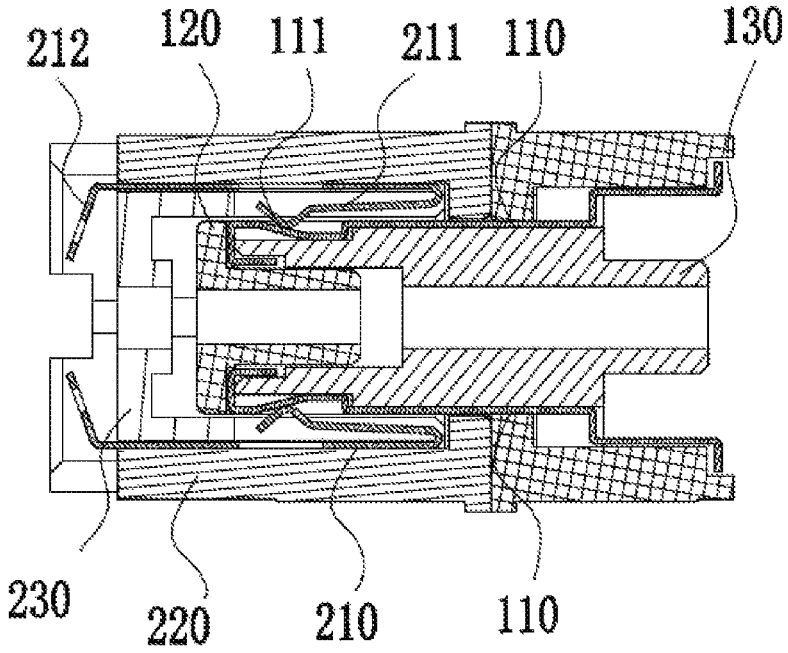
FIG. 11 is a cross-sectional view of the first connecting end and the second connecting end of FIG. 10 in an assembled state.
Figure 12:
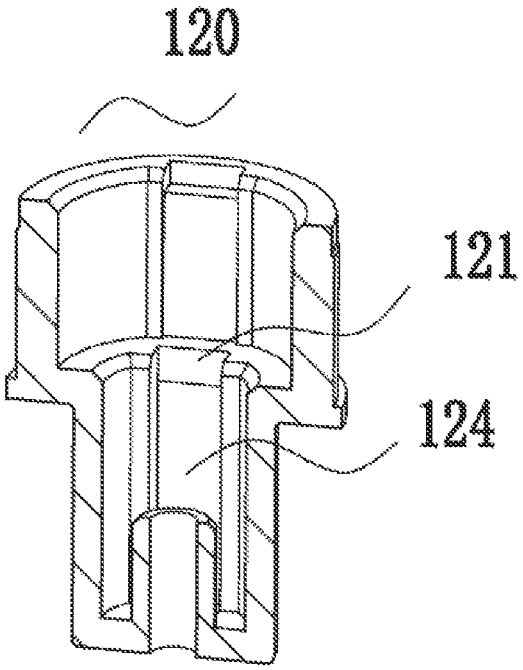
FIG. 12 is a cross-sectional perspective view of a connecting member of the electronic cigarette of FIG. 8.
Figure 13:
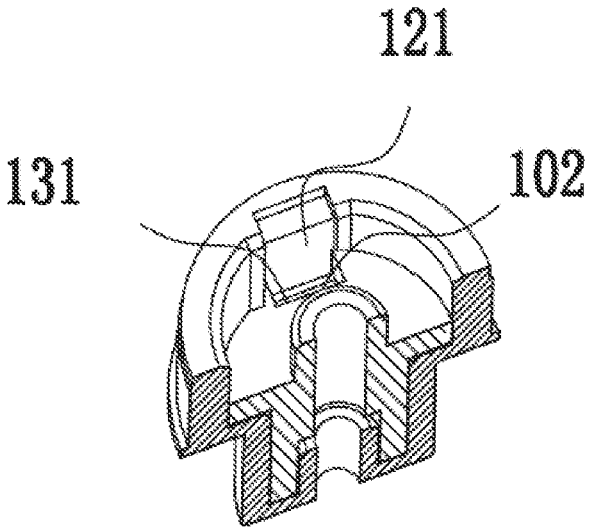
FIG. 13 is a cross-sectional perspective view of the connecting member assembled to a fixed base of the present disclosure.
Figure 14:
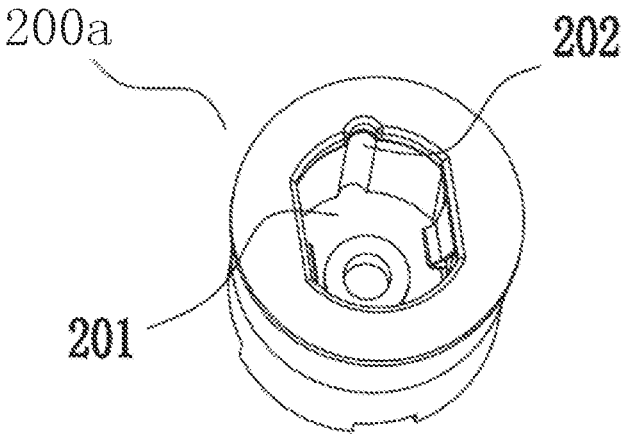
FIG. 14 is a schematic structural view of the second connecting end of FIG. 9.

Referring to FIG. 10, FIG. 11 and FIG. 14, the second connecting end 200*a* comprises two second electrically conductive elastic sheets 210, a connecting sleeve 220 and a fixing sleeve 230 nested into the connecting sleeve 220. The two second electrically conductive elastic sheets 210 are made of copper or other electrically conductive materials, and the connecting sleeve 220 and the fixing sleeve 230 are made of insulating materials. The positions of the two second electrically conductive elastic sheets 210 correspond to the positions of the two first electrically conductive elastic sheets 110, and the joint cavity 201 comprises two parallel surfaces and two arc surfaces correspondingly. The second connecting end 200*a* further comprises a locating structure, and the locating structure is adapted to distinguish the positive electrode from the negative electrode when the power supplying component 20*a* is connected to a charger (not shown) so as to prevent the power supplying component 20*a* from being inserted to the charger in an opposite direction. In this embodiment, the locating structure is a first recess 202 disposed axially on the internal wall of the fixing sleeve 230, and the first recess 202 is disposed on a symmetry axis of an arc surface. If the second electrically conductive elastic sheet 210 located at an angle of 90 degrees clockwise with respect to the arc recess is connected to the positive electrode of the power supplying element, then the second electrically conductive elastic sheet 210 located at an angle of 90 degrees counterclockwise with respect to the arc recess 202 is connected to the negative electrode of the power supplying element, so the positive electrode and the negative electrode can be distinguished from each other during the charging process, thereby avoiding accidents caused by mixing up the positive electrode and the negative electrode. As a preferred implementation, a protruding rib 232 and the first recess 202 are disposed at a same position, i.e., the first recess 202 recesses from the internal wall of the fixing sleeve 230 towards the external wall of the fixing sleeve 230 and thereby the protruding rib 232 is formed on the external wall of the fixing sleeve 230. A second recess 222 is disposed at a corresponding position on the internal wall of the connecting sleeve 220, and the second recess 222 cooperates with the protruding rib 232 to prevent the connecting sleeve 220 from rotating with respect to the fixing sleeve 230. It shall be appreciated that, in other embodiments, the protruding rib 232 may also be disposed at other positions on the external wall of the fixing sleeve 230, and position of the second recess 222 on the connecting sleeve 220 corresponds to the position of the protruding rib 232. The fixing sleeve 230 comprises two catching portions 231, and the second electrically conductive elastic sheets 210 are fixed on the fixing sleeve 230 by the catching portions 231. Further speaking, each of the first electrically conductive elastic sheets 110 comprises a clamping portion 111, and each of the second electrically conductive elastic sheets 210 comprises a bent portion 211, and the bent portion 211 is clamped to the clamping portion 111. The deformation of the bent portion 211 will generate an elastic force, which allows the first electrically conductive elastic sheets 110 and the second electrically conductive elastic sheets 210 to fit tightly, and thereby the atomizer 10*a* is connected to the power supplying component 20*a* securely.

Figure 15:
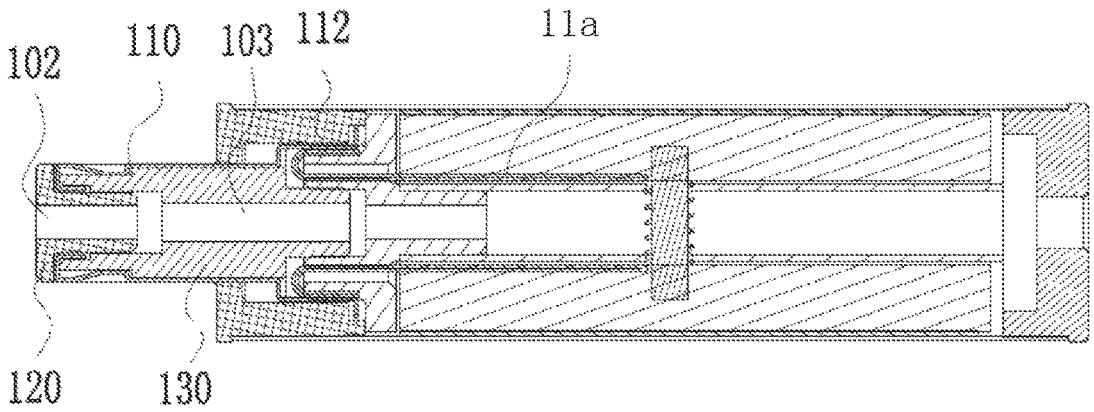
FIG. 15 is a cross-sectional view of an atomizer of the electronic cigarette of FIG. 8.

Referring to FIG. 10, FIG. 11 and FIG. 15 together, in this embodiment, the heating element within the atomizer 10*a* is a heating wire 11*a*, and two ends of the heating wire 11*a* are in contact with the internal side of the connecting portion 112 of the first electrically conductive elastic sheets 110. The positive electrode and the negative electrode of the power supplying element 20*a* are respectively connected to electrode contacting portions 212 of the second electrically conductive elastic sheets 210 through wires. According to the above descriptions, the battery supplies power to the heating wire 11*a* through the second electrically conductive elastic sheets 210 and the first electrically conductive elastic sheets 110, and the heating wire transforms the electric energy into heat energy so as to atomize the cigarette tar around the heating wire to generate smoke. Further speaking, in this embodiment, the connector 120 is provided with a first through hole 102, the fixed base 130 is provided with a second through hole 103, the first through hole 102 forms an air inlet, the second through hole 103 forms an airflow passage, and the smoke passes through the first through hole 102 and the second through hole 103 successively.

According to the above descriptions, the electronic cigarette allows the atomizer 10*a* to be fixedly connected to the power supplying component 20*a* by inserting the first connecting end 100*a* into the second connecting end 200*a*, so the electronic cigarette features a convenient connection during the usage, a simple structure and a low cost. Moreover, the circuit is powered on by clamping the first electrically conductive elastic sheets 110 to the second electrically conductive elastic sheets 210, so the contact circuit is reliable.

Figure 16:
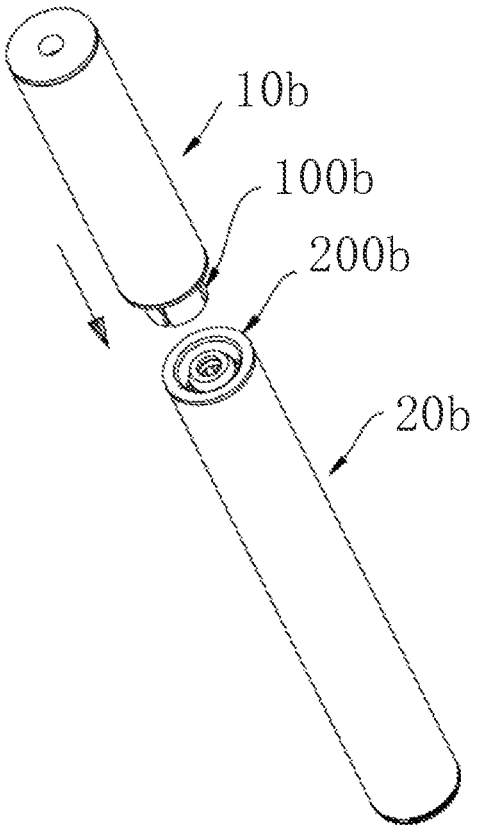
FIG. 16 is an overall schematic structural view of an electronic cigarette of one embodiment of the present disclosure.
Figure 17:
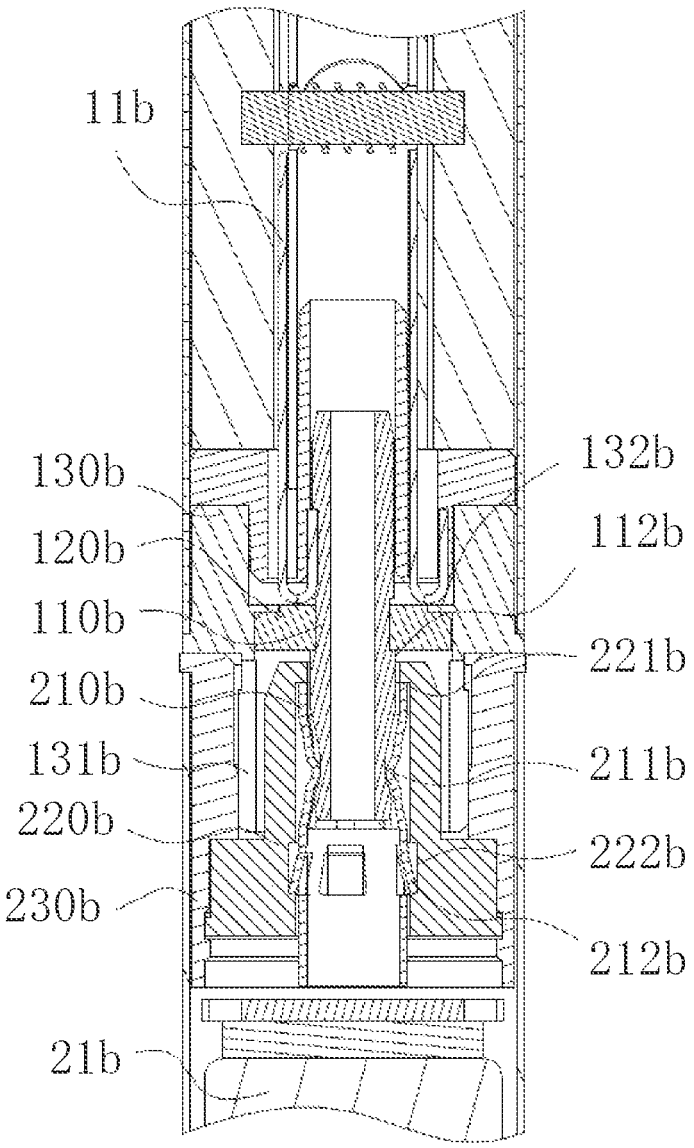
FIG. 17 is a partial cross-sectional view of the electronic cigarette of the present disclosure.
Figure 18:
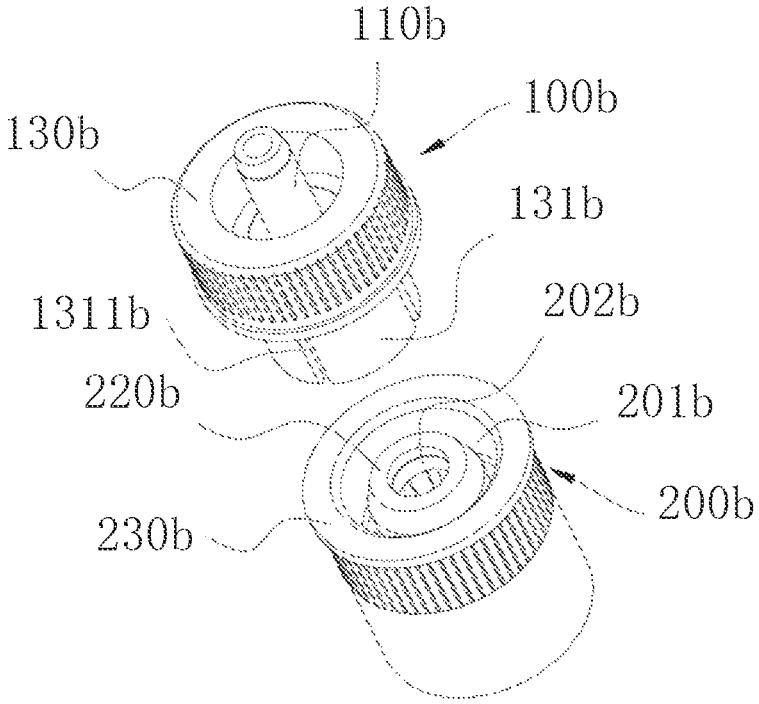
FIG. 18 is an exploded view of a first connecting end and a second connecting end of the present disclosure.

Referring to FIG. 16, FIG. 17 and FIG. 18 together, an electronic cigarette of one embodiment comprises an atomizer 10*b* and a power supplying component 20*b*. One of the atomizer 10*b* and the power supplying component 20*b* is provided with a first connecting end 100*b* while the other is provided with a second connecting end 200*b*. A heating element 11*b* is disposed within the atomizer 10*b*, and a battery 21*b* is disposed within the power supplying component 20*b*. The battery 21*b* provides electric energy for the heating element 11*b* through the first connecting end 100*b* and the second connecting end 200*b*, and the heat generated by the heating element 11*b* atomizes the cigarette liquid so as to provide the users with the smoking effect. In this embodiment, the atomizer 10*b* comprises an atomizing sleeve 101*b*, and the first connecting end 100*b* is disposed at an end of the atomizing sleeve 101*b* and connected to the atomizing sleeve 101*b*; and the power supplying component 20*b* comprises a housing 201*b*, and the second connecting end 200*b* is disposed at an end of the housing 201*b* and connected to the housing 201*b*. It shall be appreciated that, the first connecting end 100*b* and the second connecting end 200*b* can exchange their positions, i.e., the second connecting end 200*b* is disposed at an end of the atomizing sleeve 101*b* and connected to the atomizing sleeve 101*b* while the first connecting end 100*b* is disposed at an end of the housing 201*b* and connected to the housing 201*b*.

Figure 19:
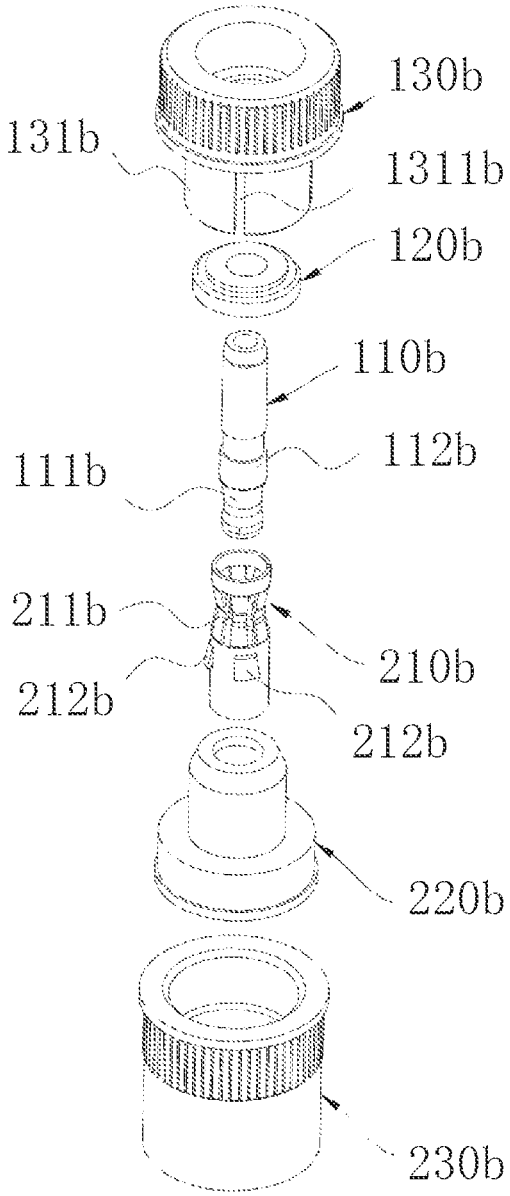
FIG. 19 is a schematic structural view of the first connecting end and the second connecting end of the present disclosure.
Figure 20:
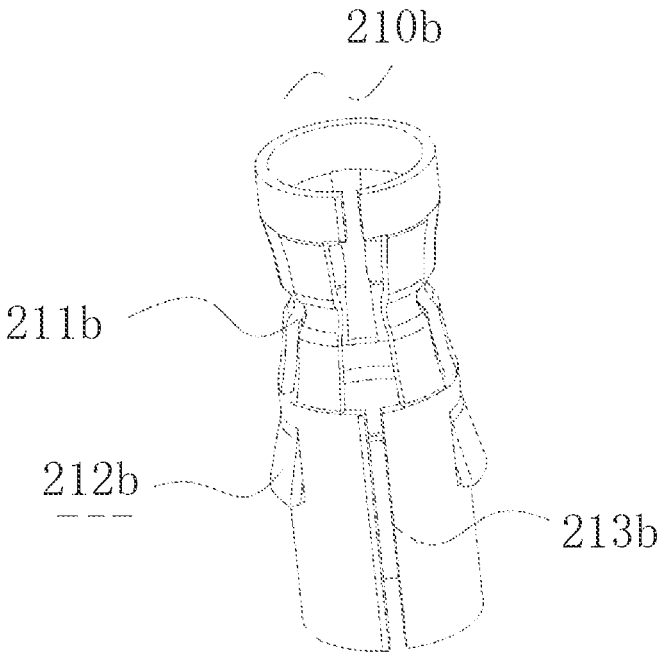
FIG. 20 is a schematic structural view of an elastic electrode ring of the present disclosure.
Figure 21:
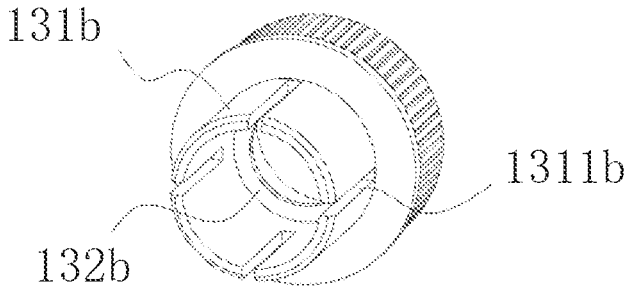
FIG. 21 is a schematic structural view of an insulated fixed base of the present disclosure.

Referring to FIG. 17 to FIG. 19, the first connecting end 100*b* comprises an internal electrode ring 110*b*, an insulated ring 120*b* and an elastic connecting member 130*b* nested together sequentially from inside to outside; and the second connecting end 200*b* comprises an elastic electrode ring 210*b*, an insulated fixed base 220*b* and an external connecting member 230*b* nested together sequentially from inside to outside. The internal electrode ring 110*b*, the elastic connecting member 130*b*, the elastic electrode ring 210*b* and the external connecting member 230*b* are all made of electrically conductive materials. The elastic electrode ring 210*b* and the external connecting member 230*b* are electrically connected to the positive electrode and the negative electrode of the battery 21*b* respectively. The internal electrode ring 110*b* and the elastic connecting member 130*b* are connected to two ends of the heating element 11*b* respectively. The internal electrode ring 110*b* and the elastic electrode ring 210*b* are in contact with each other to conduct electricity, the elastic connecting member 130*b* and the external connecting member 230*b* are in contact with each other to conduct electricity, and thereby the power supplying component 20*b* supplies power to the atomizer 10*b*. Specifically, the elastic connecting member 130*b* comprises a plug portion 131*b*, and the plug portion 131*b* has a plurality of slots 1311*b* disposed axially thereon so as to form an elastic wall. A plug-accommodating cavity 201*b* is formed between the elastic electrode ring 210*b* and the external connecting member 230*b* to accommodate the plug portion 131*b*. The external wall of the plug portion 131*b* and the internal wall of the external connecting member 230*b* are in contact with each other and fit tightly with each other due to an elastic force generated by the deformation of the elastic wall. The elastic electrode ring 210*b* is fixedly disposed within the insulated fixed base 220*b*, the elastic electrode ring 210*b* comprises a holding portion 211*b*, and the holding portion 211*b* shrinks inwardly to form a plugging hole 202*b*. The internal electrode ring 110*b* has a clamping portion 111*b*, the clamping portion 111*b* is inserted into the plugging hole 202*b*, and an elastic force generated by the deformation of the holding portion 211*b* clamps the clamping portion 111*b* so as to fixedly connect the atomizer 10*b* to the power supplying component 20*b*.

Referring to FIG. 17, and FIG. 19 to FIG. 21, the side wall of the elastic electrode ring 210*b* is further provided with a cut 213*b* axially, and the cut 213*b* extends through the whole elastic electrode ring 210*b* (see FIG. 20) to increase the elasticity of the elastic electrode ring 210*b*. A plurality of convex spigots 212*b* are distributed evenly at a lower end of the elastic electrode ring 210*b*, a plurality of concave spigots 222*b* are correspondingly disposed on the insulated fixed base 220*b*, and the convex spigots 212*b* cooperate with the concave spigots 222*b* to fixedly connect the elastic electrode ring 210*b* with the insulated fixed base 220*b* and to restrict the axial downward movement of the elastic electrode ring 210*b* with respect to the insulated fixed base 220*b*. A stepped hole 221*b* is disposed on an upper end of the insulated fixed base 220*b* (see FIG. 21), and the stepped hole 221*b* abuts against a top surface of the elastic electrode ring 210*b* so as to restrict the axial upward movement of the elastic electrode ring with respect to the insulated fixed base. The internal electrode ring 110*b* is provided with a limiting portion, and the limiting portion cooperates with the insulated ring 120*b* and the elastic connecting member 130*b* so as to restrict the axial movement of the internal electrode ring 110*b* with respect to the insulated ring 120*b* and the elastic connecting member 130*b*. Specifically, the limiting portion is a first convex shoulder 112*b* disposed on the external wall of the internal electrode ring 110*b*, the internal electrode ring 110*b* passes through the insulated ring 120*b*, and the upper surface of the first convex shoulder 112*b* abuts against the lower surface of the insulated ring 120*b*. A second convex shoulder 132*b* is disposed on the internal wall of the elastic connecting member 130*b*, and the upper surface of the insulated ring 120*b* abuts against the lower surface of the second convex shoulder 132*b*.

Due to the cooperation between the elastic electrode ring 210*b* and the internal electrode ring 110*b* as well as the cooperation between the elastic connecting member 130*b* and the external connecting member 230*b*, the electronic cigarette allows the atomizer 10*b* to be fixedly connected to the power supplying component 20*b*, so the present disclosure has the advantages that the connection during the usage is convenient and the contact conductivity is reliable.

Figure 22:
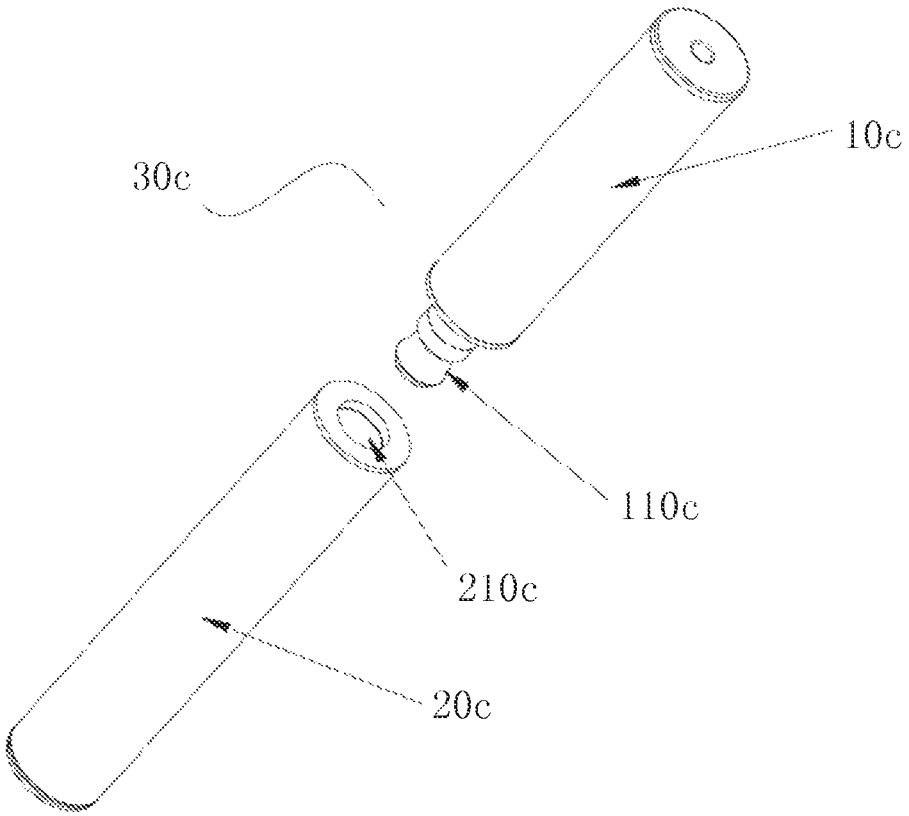
FIG. 22 is a schematic perspective structural view of a pluggable electronic cigarette of one embodiment of the present disclosure.

Referring to FIG. 22, a pluggable electronic cigarette 30*c* of one embodiment is provided. The pluggable electronic cigarette 30*c* comprises an atomizing device 10*c* and a power supplying device 20*c* electrically connected to the atomizing device 10*c*. A first connecting portion 110*c* is disposed at an end of the atomizing device 10*c*, and a second connecting portion 210*c* is disposed at an end of the power supplying device 20*c*; or, the second connecting portion 210*c* is disposed at an end of the atomizing device 10*c*, and the first connecting portion 110*c* is disposed at an end of the power supplying device 20*c*. The first connecting portion 110*c* and the second connecting portion 210*c* can directly match with each other pluggably and abut against each other tightly to achieve axial locking, thereby achieving structural connection and electrical connection simultaneously. When the electronic cigarette 30*c* is not in use, the atomizing device 10*c* can be separated from the power supplying device 20*c* simply by a gentle pulling force, so the operation is simple and reliable.

Figure 23:
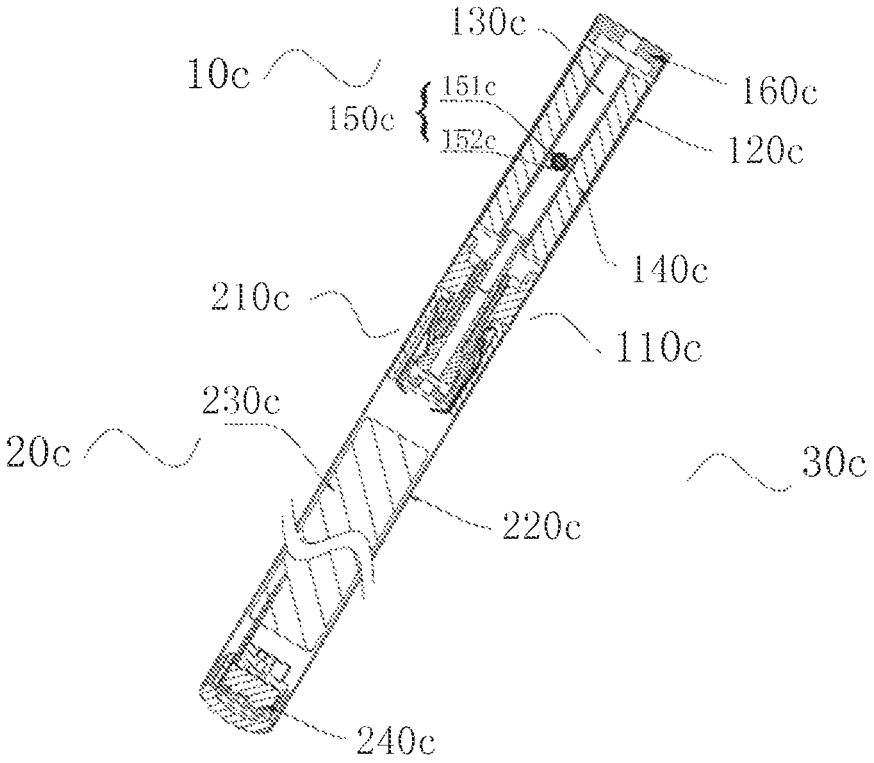
FIG. 23 is a schematic overall cross-sectional and structural view of the pluggable electronic cigarette.

Specifically, please refer to FIG. 23, which is a schematic overall cross-sectional and structural view of the pluggable electronic cigarette 30*c* of this embodiment.

The atomizing device 10*c* comprises a first housing 120*c*, the first connecting portion 110*c* disposed at an end of the first housing 120*c*, and further comprises a liquid storage cavity 140*c* and an atomizing component 150*c* disposed within the first housing 120*c*, an airflow passage 130*c* formed within the first housing 120*c* and running through the first housing 120*c* axially, and a nozzle 160*c* disposed at the other end of the first housing 120*c*. The liquid storage cavity 140*c* is used for storing the cigarette liquid, and the atomizing component 150*c* is used for atomizing the cigarette tar. Specifically, the atomizing component 150*c* comprises a heating wire 151*c* and a fixed base 152*c*, the heating wire 151*c* has two electrically conductive pins (not shown), the fixed base 152*c* is provided with two through holes (not shown), and the two electrically conductive pins pass through the two through holes respectively to be electrically connected to the first connecting portion 110*c*.

The power supplying device 20*c* comprises a second housing 220*c*, the second connecting portion 210*c* disposed at an end of the second housing 220*c*, a power supplying unit 230*c* and a controlling unit (not shown) disposed within the second housing 220*c*, and a lampshade 240*c* disposed at the other end of the second housing 220*c*. The power supplying unit 230*c* is adapted to supply power to the atomizing device 10*c*, and the controlling unit is adapted to control the electrical connection of the electronic cigarette 30*c* or to sense sucking actions or something else and this will not be described in detail herein. The lampshade 240*c* is adapted to emit light, usually light generated by an LED (Light-Emitting Diode), when the user is smoking so as to provide the user with the feeling that the cigarette is burning.

Figure 24:
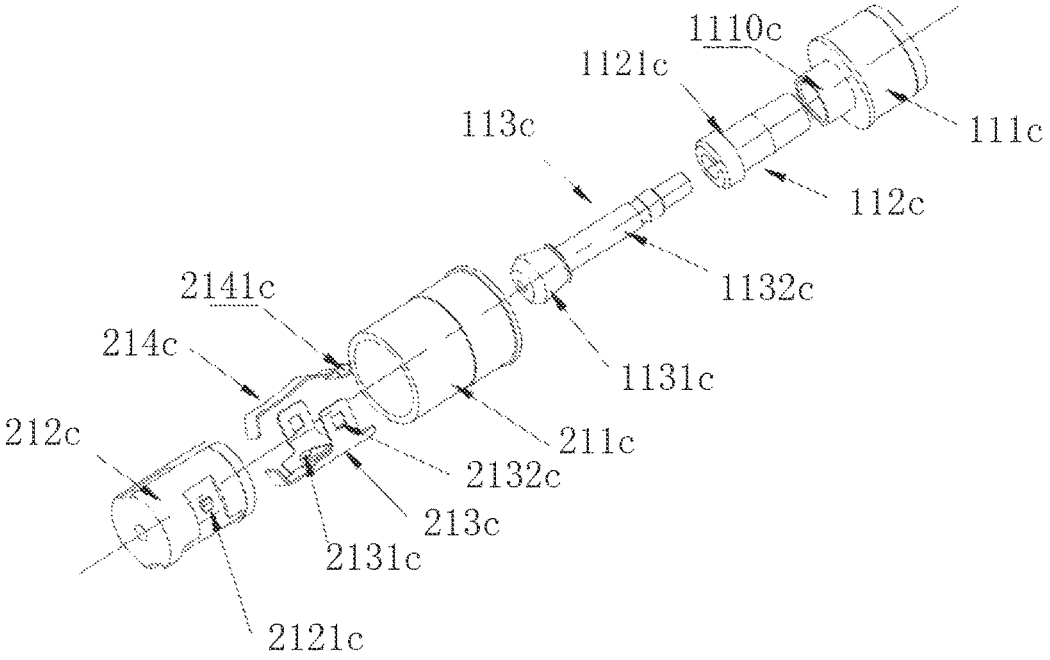
FIG. 24 is a schematic exploded structural view of a first connecting portion and a second connecting portion.
Figure 25:
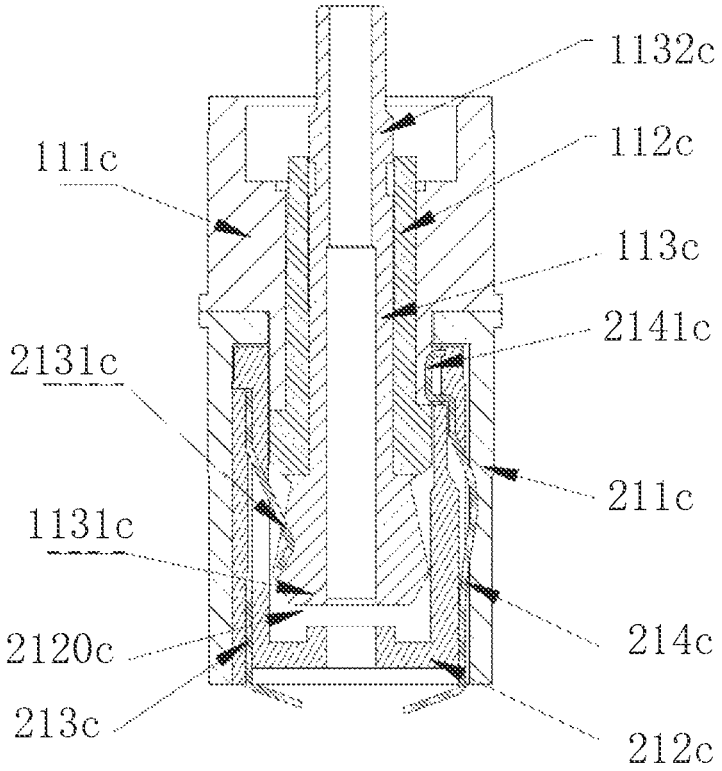
FIG. 25 is a schematic cross-sectional and structural view of the first connecting portion and the second connecting portion in an assembled state.

Further speaking, please refer to FIG. 24 and FIG. 25 together, which are schematic views of the first connecting portion 110*c* and the second connecting portion 210*c*.

In this embodiment, the first connecting portion 110*c* is fixedly disposed at an end of the atomizing device 10*c* so as to match with the second connecting portion 210*c* pluggably. The first connecting portion 110*c* comprises a first electrode 111*c*, a second electrode 113*c* disposed within the first electrode 111*c* and an insulated ring 112*c* disposed between the first electrode 111*c* and the second electrode 113*c*. Specifically, the second electrode 113*c* comprises a convex portion 1131*c* disposed at one end thereof and a plug portion 1132*c* disposed at the other end thereof, and the plug portion 1132*c* and the insulated ring 112*c* are disposed coaxially. The insulated ring 112*c* is provided with a flange 1121*c*, the first electrode 111*c* is provided with a journal 1110*c*, and the flange 1121*c* is located between the convex portion 1131*c* and the journal 1110*c* so as to separate the convex portion 1131*c* from the journal 1110*c*, and in this way the first electrode 111*c* is insulated from the second electrode 113*c*. The second electrode 113*c* is provided with an axial hole (not shown), and the axial hole communicates with the airflow passage 130*c*. When the user is smoking, the air and the atomized cigarette tar reach the nozzle 160*c* through the axial hole and the airflow passage 130*c*, and then reach the mouth of the user so that the user can have the feeling of smoking.

In this embodiment, both the first electrode 111*c* and the second electrode 113*c* are electric conductors, the first electrode 111*c* is in a tubular form, and the insulated ring 112*c* is nested into the first electrode 111*c*.

The second connecting portion 210*c* is fixedly disposed at an end of the power supplying device 20*c*, and is adapted to match with the first connecting portion 110*c* pluggably.

Figure 26:
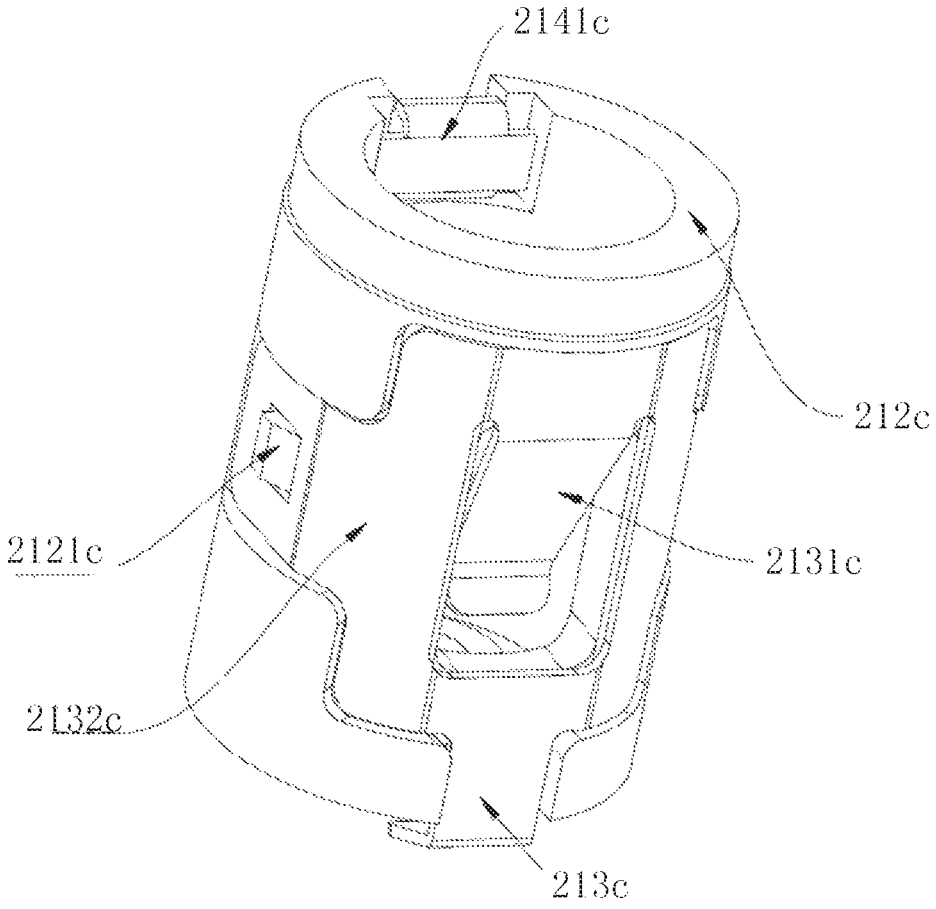
FIG. 26 is a schematic perspective structural view of an insulated base and a first elastic sheet in an assembled state.

The second connecting portion 210*c* comprises a sleeve 211*c*, an insulated base 212*c* disposed inside the sleeve 211*c*, and a first elastic sheet 213*c* and a second elastic sheet 214*c* fixed between the insulated base 212*c* and the sleeve 211*c*. A plugging cavity 2120*c* is formed within the insulated base 212*c*. Specifically, as shown in FIG. 26, an irregular groove (not shown) is disposed on the insulated base 212*c*, two convex lumps 2121*c* are disposed axially and symmetrically at the groove, and the two convex lumps 2121*c* are adapted to be clamped to the first elastic sheet 213*c*. Specifically, the first elastic sheet 213*c* comprises a bent portion 2131*c* and two clamping portions 2132*c* extending outward from the bent portion 2131*c*, and the bent portion 2131*c* bends towards the plugging cavity 2120*c* and is adapted to abut against the second electrode 113*c*. The two clamping portions 2132*c* are provided with through holes (not shown) respectively, and the through holes match and clamp with the convex lumps 2121*c* respectively so that the first elastic sheet 213*c* is fixedly clamped to the insulated base 212*c*. The second elastic sheet 214*c* comprises an elastic portion 2141*c*, and the elastic portion 2141*c* is fixed on one end of the insulated base 212*c* so as to abut against the first electrode 111*c* elastically.

In this embodiment, both the first elastic sheet 213*c* and the second elastic sheet 214*c* are electric conductors, and the first elastic sheet 213*c* and the second elastic sheet 214*c* have elasticity. Both the sleeve 211*c* and the insulated base 212*c* are made of plastic materials.

When the atomizing device 10*c* is plugged into the power supplying device 20*c*, specifically as shown in FIG. 25, the first electrode 111*c* is in a tubular form and matches with the sleeve 211*c*; the second electrode 113*c* is plugged into the plugging cavity 2120*c*, the convex portion 1131*c* abuts against the bent portion 2131*c* elastically so that the bent portion 2131*c* approaches the insulated base 212*c*. Moreover, the convex portion 1131*c* has an inverted conical surface, so the convex portion 1131*c* can abut against the plugging cavity 2120*c* tightly and will not be pulled out easily. The elastic portion 2141*c* of the second elastic sheet 214*c* abuts against the first electrode 111*c*. The first electrode 111*c* and the second electrode 113*c*, serving as the positive connecting end and the negative connecting end of the first connecting portion 110*c* respectively, are distributed axially; and the first elastic sheet 213*c* and the second elastic sheet 214*c*, serving as the positive connecting end and the negative connecting end of the second connecting portion 210*c* respectively, are distributed transversely and abut against the second electrode 113*c* and the first electrode 111*c* so that axial locking and electrical connection are achieved simultaneously.

In this embodiment, at an end of the atomizing device 10*c*, the two electrically conductive pins of the heating wire 151*c* are electrically connected to the first electrode 111*c* and the second electrode 113*c* respectively; and at an end of the power supplying device 20*c*, the power supplying unit 230*c* is electrically connected to the first elastic sheet 213*c* and the second elastic sheet 214*c*. Thus, through the electrical connection between the first connecting portion 110*c* and the second connecting portion 210*c*, an electrical circuit is formed between the atomizing device 10*c* and the power supplying device 20*c*, so the electronic cigarette 30*c* can operate normally.

Apparently, in other embodiments, the first connecting portion 110*c* may also be disposed at an end of the power supplying device 20*c*, and the second connecting portion 210*c* is disposed at an end of the atomizing device 10*c* correspondingly, and the axial locking and the electrical connection of the electronic cigarette 30*c* are achieved by plugging the power supplying device 20*c* into an end of the atomizing device 10*c*. Correspondingly, at an end of the atomizing device 10*c*, the two electrically conductive pins of the heating wire 151*c* are electrically connected to the first elastic sheet 213*c* and the second elastic sheet 214*c* respectively; and at an end of the power supplying device 20*c*, the power supplying unit 230*c* is electrically connected to the first electrode 111*c* and the second electrode 113*c*.

According to the above description, the structural connection and the electrical connection between the atomizing device 10*c* and the power supplying device 20*c* can be achieved simultaneously simply by plugging the atomizing device 10*c* into the power supplying device 20*c*, and this connection is convenient in operation and can ensure a long service life.

What described above are only some of the embodiments of the present disclosure, which are provided to facilitate understanding of the present disclosure but are not intended to limit the technical solutions of the present disclosure in any way or to exhaust all embodiments of the present disclosure. Accordingly, any modification or equivalent substitutions made to the technical solutions without departing from the spirits and scope of the present disclosure shall all be covered within the scope of the present disclosure.

What is claimed is:

1. An electronic cigarette, comprising:

an atomizer;

a battery pack supplying power to the atomizer; and a pluggable connecting means provided between the atomizer and the battery pack and configured to be an elastic snap or a detachable clip means so that the atomizer and the battery pack are connected together pluggably;

wherein the pluggable connecting means comprises a first connecting portion on one of the atomizer and the battery pack, and a second connecting portion on the other one of the atomizer and the battery pack; the first connecting portion comprises a first electrode and a second electrode, the first electrode and the second electrode are distributed axially with respect to the first connecting portion, the second connecting portion comprises a sleeve, an insulated base disposed inside the sleeve, and a first elastic sheet and a second elastic sheet fixed between the insulated base and the sleeve, a plugging cavity is defined within the insulated base; and when the first connecting portion is inserted into the plugging cavity, the first elastic sheet and the second elastic sheet abut against the second electrode and the first electrode respectively so that axial locking and electrical connection between the first connecting portion and the second connecting portion are achieved.

2. The electronic cigarette of claim 1, wherein the first connecting portion further comprises an insulated ring disposed between the first electrode and the second electrode, the second electrode comprises a convex portion disposed at one end thereof, the convex portion is adapted to match with the plugging cavity, the second electrode further comprises a plug portion disposed at the other end thereof, and the plug portion and the insulated ring are disposed coaxially.

3. The electronic cigarette of claim 2, wherein the first electrode is tubular shaped, and the insulated ring is nested into the first electrode.

4. The electronic cigarette of claim 3, wherein the insulated ring is provided with a flange, the first electrode is provided with a journal, and the flange is located between the convex portion and the journal so as to separate the convex portion from the journal.

5. The electronic cigarette of claim 1, wherein the first elastic sheet comprises a bent portion and two clamping portions extending outward from the bent portion, the bent portion bends towards the plugging cavity and is adapted to abut against the second electrode, and the two clamping portions are clamped and fixed onto the insulated base respectively.

* * * * *